US005279369A

United States Patent [19]

Brammer

[11] Patent Number: 5,279,369

[45] Date of Patent: Jan. 18, 1994

[54] TIEBACK RECEPTACLE WITH UPWARD AND DOWNWARD FACING FUNNEL SECTIONS

[75] Inventor: Norman Brammer, Fyvie Turiff, Scotland

[73] Assignee: ABB Vetco Gray Inc., Houston, Tex.

[21] Appl. No.: 3,752

[22] Filed: Jan. 13, 1993

[51] Int. Cl.[5] ..... E21B 43/00

[52] U.S. Cl. ..... 166/368; 166/345; 285/24

[58] Field of Search ..... 166/340, 344, 348, 349, 166/368; 285/24, 27, 39, 115, 18, 85

[56] References Cited

U.S. PATENT DOCUMENTS 4,691,780 9/1987 Galle, Jr. et al. ..... 166/368 X
4,696,493 9/1987 Brammer ..... 166/345 X
4,819,967 4/1989 Calder et al. ..... 285/18
4,872,708 10/1989 Abreo, Jr. ..... 285/39
4,903,993 2/1990 Brammer ..... 285/24
4,976,458 12/1990 Hosie et al. ..... 285/24

*Primary Examiner*—Thuy M. Bui
*Attorney, Agent, or Firm*—James E. Bradley

[57] ABSTRACT

A subsea well employs a tieback receptacle which has a downward facing funnel and an upward facing funnel. The downward facing funnel guides the receptacle over the wellhead housing. The tieback conduit is then lowered from a vessel into engagement with the tieback receptacle. The tieback conduit has a securing device that secures the tieback conduit to a profile in the tieback receptacle without rotation.

20 Claims, 1 Drawing Sheet

TIEBACK RECEPTACLE WITH UPWARD AND DOWNWARD FACING FUNNEL SECTIONS

BACKGROUND OF THE INVENTION

1. Field of the Invention

This invention relates in general to subsea well drilling equipment, and in particular to a tieback system for a subsea well that has a downward facing funnel section and an internal profile for releasably receiving the lower end of a tieback conduit.

2. Description of the Prior Art

In one type of offshore well drilling, a subsea wellhead housing will be located at the sea floor. Casing will be cemented in the well. After installing at least one or more strings of casing, the drilling riser will be removed. A tieback riser will be installed with the tieback connector connecting the tieback riser to the wellhead housing. The tieback riser extends to the surface where a Christmas tree will be eventually installed for production.

In some cases, one drilling rig drills the well and installs casing. The first vessel will install a cap and move from location. At a later date, a production platform will position itself over the well for completion. The production platform will remove the cap and connect the subsea wellhead housing to the production platform by a tieback riser and a tieback connector. The production platform then completes the well.

One type of tieback connector employs a downward facing funnel mounted to the lower end of the tieback conduit. The funnel slides over the wellhead housing. In one type of tieback connector, a locking element such as movable dogs will engage grooves on the exterior. With the locking element on the exterior, full bore access to the wellhead housing is provided. However, this type is fairly large and expensive. Often a number of wells are drilled through a template at the same location. Because of the close spacing of the wellhead housings, the large outer diameter of the funnel and connector can be a problem for clearances.

In another type, the tieback connector latches into interior grooves formed in the bore of the wellhead housing. While this type has a lesser outer diameter than the external connector type, the locking element for the interior normally restricts full bore access to the wellhead. The lack of full bore access has disadvantages in some completion techniques.

SUMMARY OF THE INVENTION

In this invention, a tieback receptacle will be placed normally on the subsea wellhead housing after casing has been installed. The tieback receptacle has a downward facing funnel which slides over the wellhead housing. The tieback receptacle has connection means on the funnel for connecting the funnel to the exterior of the wellhead housing. The connection means comprises a locking element that ratchets over grooves provided on the exterior of the wellhead housing.

The tieback receptacle also has an upward facing funnel. A profile locates in the tieback receptacle in a position that will be above the wellhead housing. If two vessels are used, the first drilling vessel will place a cap in the profile to protect the well prior to arrival of the production vessel.

To install the tieback riser, the operator removes the cap and lowers tieback riser or conduit. The lower end of the tieback conduit slides into the upward facing funnel and secures into the profile of the tieback receptacle. The securing means for the tieback conduit is preferably a lock nut which is rotated by a running tool to engage grooves or threads in the tieback receptacle. The inner diameter of the securing means is the same as the inner diameter of the wellhead housing, providing full bore access.

DETAILED DESCRIPTION OF THE INVENTION

Figure 1:
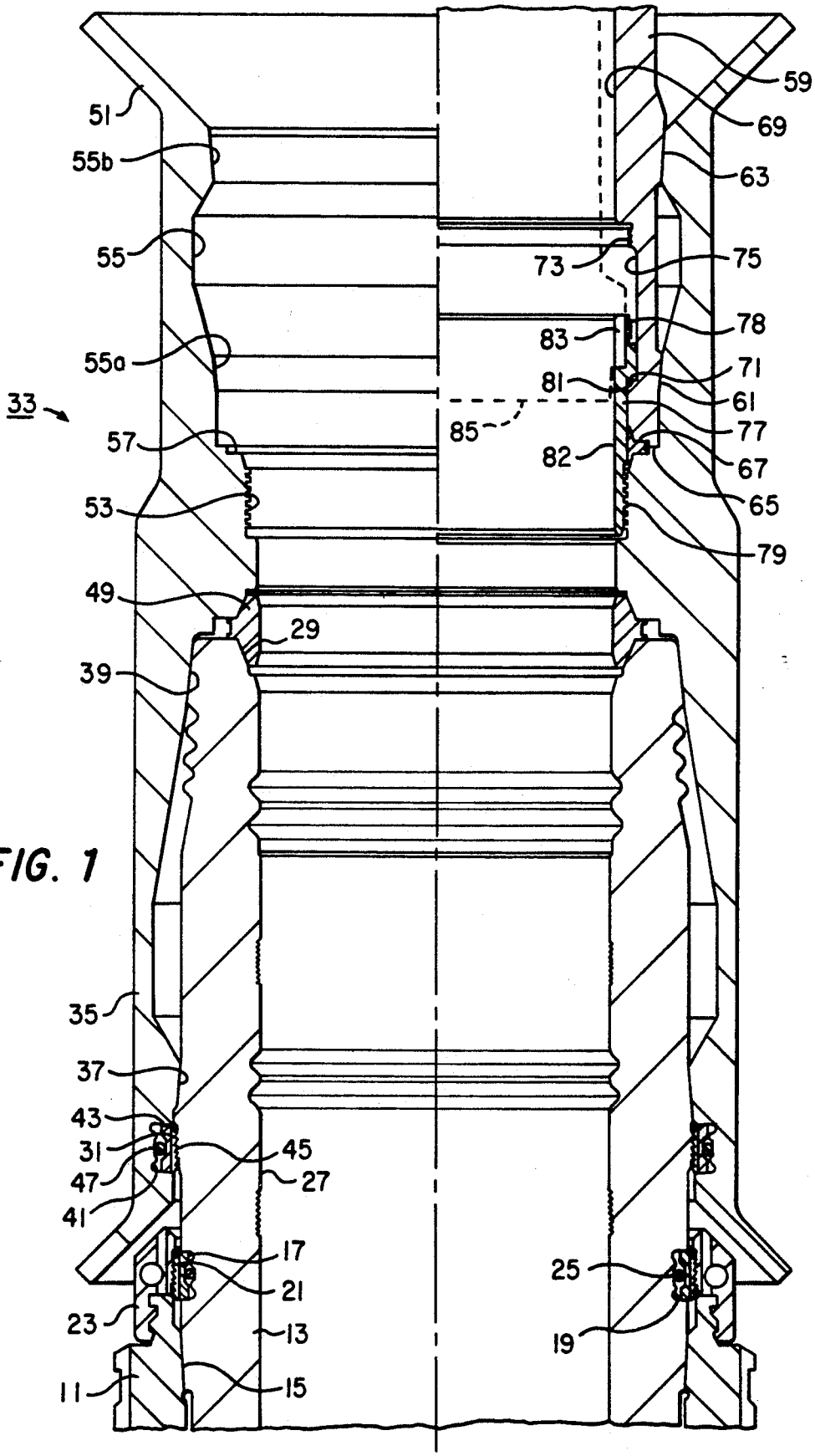
FIG. 1 is the sole figure and it shows on the left side the tieback receptacle landed in place, and on the right side the tieback conduit latched into the tieback receptacle.

The subsea well assembly of this invention includes a conventional outer wellhead housing 11 which will be supported at the sea floor. Outer wellhead housing 11 secures to large diameter conduit that extends into the well to a first depth. An inner or high pressure wellhead housing 13 will land in the outer wellhead housing 11. Inner wellhead housing 13 secures to conduit that extends to a greater depth in the well.

Inner wellhead housing 13 has axially spaced apart conical seats 15 (only one shown) that wedge tightly in mating seats in the bore of the outer wellhead housing 11. During installation, inner wellhead housing 13 is pressed into outer wellhead housing 11 with great force. A split latch ring 17 located in a recess 19 on the exterior of inner wellhead housing 13 ratchets against threads 21 of a retainer ring 23 during the installation procedure. Latch ring 17 retains the inner wellhead housing 13 in position in outer wellhead housing 11. An elastomeric ring 25 in recess 19 urges latch ring 17 to the outer engaged position with threads 21. Inner wellhead housing 13 has an axial bore 27 and a rim 29 at its upper end. A set of external grooves, preferably threads 31, are located on the exterior of inner wellhead housing 13.

After the well has been drilled and casing (not shown) installed in inner wellhead housing 13, a tieback receptacle 33 will be lowered over wellhead housing 13. Tieback receptacle 33 has a downward facing funnel 35 for guiding tieback receptacle 33 in place. Downward facing funnel 35 has a lower tapered seat 37 and an upper tapered seat 39, axially spaced apart from each other and located in the interior. Seats 37, 39 are conical and engage mating conical surfaces formed on the exterior of inner wellhead housing 13. Seats 37, 39 will tightly wedge the downward facing funnel 35 on inner wellhead housing 13.

A securing means will secure tieback receptacle 33 to inner wellhead housing 13. The securing means is similar to latch ring 17 and includes a recess 41 located below lower tapered seat 37. A locking element comprising a split ring 43 is carried in recess 41. Split ring 43 has internal grooves, preferably threads 45, that will ratchet and engage with inner wellhead housing 13 threads 31. Recess 41 has a larger radial dimension than split ring 43, enabling split ring 43 to expand and contract in recess 41. An elastomeric ring 47 locates in recess 41 and engages the exterior of split ring 43 for urging it radially inward.

Tieback receptacle 33 will carry a metal seal 49 when it is being lowered onto inner wellhead housing 13. Metal seal 49 seals between a tapered portion of rim 29 and a tapered portion similarly formed in tieback receptacle 33. Tieback receptacle 33 extends upward from inner wellhead housing 13, terminating in an upward facing funnel 51 on its upper end.

A profile is formed in the upper section of tieback receptacle 33 above inner wellhead housing 13. The profile includes at least one profile groove, which preferably comprises a set of profile threads 53. A recess 55 locates above threads 53. Recess 55 has a lower tapered seat 55*a* and an upper tapered seat 55*b*, axially spaced apart from each other. Seats 55*a*, 55*b* are conical and have substantially the same degree of taper as seats 15 and 37. A profile shoulder 57 faces upward and locates between recess 55 and threads 53.

A tieback riser or conduit has a tieback conduit connector 59 on its lower end which will be lowered into tieback receptacle 33. Tieback conduit connector 59 has a lower exterior seat 61 that engages lower tapered seat 55*a*. An upper tapered seat 63 engages upper tapered seat 55*b*. Seats 61, 63 have the same degree of taper as seats 55*a*, 55*b* for tightly wedging tieback conduit connector 59 into the profile 53.

Tieback conduit connector 59 has a lower end 65 that lands on upward facing shoulder 57. A seal 67 locates on shoulder 57 for sealing between lower end 65 and shoulder 57. Tieback conduit connector 59 has an axial bore 69, the upper and lower portions of which are of the same inner diameter as the inner diameter of bore 27 of inner wellhead housing 13. Bore 69 has an upward facing shoulder 71 located at the lower end of a recess 75. A set of threads 73 are located at the upper end of recess 75.

A securing means will connect the tieback conduit connector 59 to the tieback receptacle 33. The securing means includes a lock nut 77 that is movable between an upper position and a lower position. Lock nut 77 has a set of upper threads 78 that initially engage threads 73 in tieback conduit connector 59. When engaged, lock nut 77 remains in the upper position. Lock nut 77 has an exterior portion comprising a set of lower threads 79 which engage profile threads 53. A downward facing shoulder 81 on the exterior of lock nut 77 engages upward facing shoulder 71 in tieback conduit connector 59. Lock nut 77 has an axial bore 82 extending through it which has an inner diameter that is the same as the inner diameter of bore 27 of inner wellhead housing 13.

Rotation means will be employed to move lock nut 77 from the upper to the lower position. The rotation means includes a plurality of axially extending slots 83 in the upper end of bore 82. Slots 83 are engaged by a conventional running tool 85, shown by dotted lines. Running tool 85 has keys that engage slots 83. Running tool 85 will be lowered on drill pipe.

In operation, the well will be initially drilled and outer wellhead housing 11, inner wellhead housing 13 and casing installed in inner wellhead housing 13. The drilling riser is then removed and tieback receptacle 33 lowered with a running tool (not shown) suspended on drill pipe. When doing so, funnel 35 will contact and slide over inner wellhead housing 13. Seats 37, 39 will wedge funnel 35 in position with the assistance of the weight of the drill pipe. As funnel 35 wedges in position, split ring 43 will ratchet over the threads 31, securing the tieback receptacle 33 to inner wellhead housing 13. No rotation takes place during installation of the tieback receptacle 33 on inner wellhead housing 13.

If a production platform is to be used for completion of the well, the drilling vessel, which is usually a floating drilling rig, will install a cap (not shown) in receptacle 33 by securing it to profile threads 53. The drilling vessel will then move from the location. The left side of FIG. 1 illustrates the subsea well at this point, with the exception of not showing the cap nor casing. If the same vessel is drilling and completing the well, the cap may not be required.

When the tieback conduit is to be installed, the operator removes the cap if one has been installed and lowers tieback conduit from the vessel. The tieback conduit will have on its lower end tieback conduit connector 59. Lock nut 77 will be carried in recess 75, with threads 78 engaging threads 73. Upward facing funnel 51 will guide the lower end 65 into the receptacle 33. The weight of the tieback conduit will wedge the mating tapered seats 61, 63 with seats 55*a*, 55*b*. The tieback conduit will not be rotated during the stabbing procedure.

After the tieback conduit connector 59 has stabbed into receptacle 33, the operator will lower running tool 85 through the tieback conduit on drill pipe. The keys (not shown) of running tool 85 will engage slots 83 of lock nut 77. The operator rotates the drill pipe relative to the tieback conduit to unscrew threads 78 from threads 73. The lock nut 77 will then drop, with threads 79 contacting threads 53. The operator continues to rotate running tool 85 to tighten lock nut 77 to threads 53. In doing so, shoulder 81 will bear downward on shoulder 71, causing sealing engagement of seal 67 and tight engagement of tieback conduit connector 59 with receptacle 33.

The operator then carries on with the remaining steps in completing the well. Full bore access is provided for a variety of operations. Tieback connectors (not shown) will connect casing from the casing hangers (not shown) installed in inner wellhead housing 13 to production control equipment at the vessel.

If at a later date the tieback conduit connector 59 is to be removed, the operator will lower running tool 85 on drill pipe. The operator rotates look nut 77 in the opposite direction to unscrew it from threads 53. Straight upward lifting force will lift tieback conduit connector 59 from receptacle 33. For salvage purposes, if the well is to be later abandoned, a retrieving tool (not shown) optionally could be employed to rotate tieback receptacle 33 to unscrew split ring 43 from threads 31. An antirotation key (not shown) would prevent rotation of split ring 43 relative to downward facing funnel 35.

The invention has significant advantages. The funnel has a small outer diameter as a result of the split ring securing device. This provides additional space in tight clearance areas where a number of wells are being drilled. The tieback receptacle has full bore access.

While the invention has been shown in only one of its forms, it should be apparent to those skilled in the art that it is not so limited, but is susceptible to various changes without departing from the scope of the invention.

I claim:

1. In a subsea well having a wellhead housing extending upward from a sea floor, an improved means for tying back a tieback conduit from a surface platform to the wellhead housing, comprising in combination:

a tieback receptacle having a downward facing funnel which is received over the wellhead housing, the tieback receptacle having an upper portion protruding above the wellhead housing which has an interior profile;

connection means for connecting the tieback receptacle onto the wellhead housing; and securing means for releasably securing the tieback conduit to the interior profile of the tieback receptacle.

2. The subsea well according to claim 1 wherein the securing means allows the tieback conduit to be stabbed into and secured to the interior profile of the tieback receptacle without rotation of the tieback conduit.

3. The subsea well according to claim 1 further comprising an upward facing funnel on the upper portion of the receptacle for guiding the tieback conduit into the interior profile.

4. The subsea well according to claim 1 wherein the wellhead housing has a set of exterior grooves, and wherein the connection means engages the exterior grooves.

5. The subsea well according to claim wherein the interior profile has at least one internal groove, and wherein the securing means comprises:

a lock nut carried in a lower end of the tieback conduit for rotation relative to the tieback conduit, the lock nut having an external portion which engages the internal groove in the profile; and rotation means for rotating the lock nut relative to the receptacle to cause engagement of the external portion of the lock nut with the internal groove.

6. The subsea well according to claim 1 wherein the profile has a set of internal threads located below an upward facing shoulder, and wherein the securing means comprises:

a lock nut carried in a lower end of the tieback conduit for rotation relative to the tieback conduit, the lock nut having a set of external threads which engage the internal threads in the profile, the external threads being located below a downward facing shoulder in the lock nut; and rotation means for rotating the lock nut relative to the receptacle to screw the external threads into the internal threads and to cause the downward facing shoulder to bear against the upward facing shoulder.

7. The subsea well according to claim 1 wherein the wellhead housing has a bore with an inner diameter, and wherein the securing means has a bore with an inner diameter that is at least equal to the inner diameter of the bore of the wellhead housing.

8. In a subsea well having a wellhead housing extending upward from a sea floor, the wellhead housing having an axial bore and an exterior having at least one set of exterior grooves, an improved means for tying back a tieback conduit from a surface platform to the wellhead housing, comprising in combination:

a tieback receptacle having a downward facing funnel which is received over the wellhead housing, the tieback receptacle having an upper portion protruding above the wellhead housing which has an interior profile;

connection means mounted to the tieback receptacle for engaging the exterior grooves of the wellhead housing for connecting the tieback receptacle to the wellhead housing;

securing means mounted to a lower end of the tieback conduit for releasably securing the tieback conduit to the interior profile of the tieback receptacle; and an upward facing funnel on the upper portion of the receptacle for guiding the lower end of the tieback conduit into the interior profile.

9. The subsea well according to claim 8 wherein the securing means allows the tieback conduit to be stabbed into and secured to the tieback receptacle without rotation of the tieback conduit.

10. The subsea well according to claim 8 wherein the interior profile has at least one internal groove, and wherein the securing means comprises:

a lock nut carried in a lower end of the tieback conduit for rotation relative to the tieback conduit, the lock nut having an external portion which engages the internal groove in the profile; and rotation means for rotating the lock nut relative to the receptacle to cause engagement of the external portion of the lock nut with the internal groove.

11. The subsea well according to claim 8 wherein the profile has a set of internal threads located below an upward facing shoulder, and wherein the securing means comprises:

a lock nut carried in a lower end of the tieback conduit for rotation relative to the tieback conduit, the lock nut having a set of external threads which engage the internal threads in the profile, the external threads being located below a downward facing shoulder in the lock nut; and rotation means for rotating the lock nut relative to the receptacle to screw the external threads into the internal threads and to cause the downward facing shoulder to bear against the upward facing shoulder.

12. The subsea well according to claim 8 wherein the wellhead housing bore has an inner diameter, and wherein the securing means has a bore with an inner diameter that is at least equal to the inner diameter of the bore of the wellhead housing.

13. The subsea well according to claim 8 wherein the connection means comprises:

a locking element having a set of internal grooves which engage the exterior grooves on the wellhead housing; and means for allowing the locking element to radially contract and expand relative to the downward facing funnel to ratchet and latch into the exterior grooves of the wellhead housing without rotation.

14. The subsea well according to claim 8 wherein the connection means comprises:

a split ring locking element having a set of internal grooves which engage the exterior grooves on the wellhead housing;

means including a recess in the downward facing funnel for allowing the locking element to radially contract and expand relative to the downward facing funnel to ratchet and latch into the exterior grooves of the wellhead housing without rotation; and an elastomeric ring located in the recess outward of the locking element for urging the locking element radially inward.

15. In a subsea well having a wellhead housing extending upward from a sea floor, the wellhead housing having an axial bore and an exterior having at least one set of exterior grooves, an improved means for tying back a tieback conduit from a surface platform to the wellhead housing, comprising in combination:

a tieback receptacle having a downward facing funnel which is received over the Wellhead housing, the tieback receptacle having an upper portion protruding above the wellhead housing which has an interior profile having at least one internal groove and an upward facing shoulder;

an internal recess located in the downward facing funnel;

a locking element carried in the internal recess and having a set of internal grooves which engage the exterior grooves on the wellhead housing, the recess allowing the locking element to radially contract and expand relative to the downward facing funnel to ratchet and latch into the exterior grooves of the wellhead housing without rotation;

a lock nut carried in a lower end of the tieback conduit for rotation relative to the tieback conduit, the lock nut having an external portion which engages the internal groove in the profile, the external portion being located below a downward facing shoulder in the lock nut;

rotation means for rotating the lock nut relative to the receptacle to secure the external portion into the internal groove of the profile and to cause the downward facing shoulder to bear against the upward facing shoulder in the profile; and an upward facing funnel on the upper portion of the receptacle for guiding the lower end of the tieback conduit into the interior profile.

16. The subsea well according to claim 15 wherein the wellhead housing bore has an inner diameter, and wherein the lock nut has a bore with an inner diameter that is at least equal to the inner diameter of the wellhead housing bore.

17. The subsea wellhead according to claim 15 further comprising:

an elastomeric ring located in the recess outward of the locking element urging the locking element radially inward.

18. A method for tying back a tieback conduit from a surface platform to a subsea wellhead housing, comprising:

providing a tieback receptacle with a downward facing funnel and an upper portion which has an interior profile;

lowering the tieback receptacle, guiding the downward facing funnel over the wellhead housing and connecting the tieback receptacle to the wellhead housing; then lowering the tieback conduit into the tieback receptacle and securing the tieback conduit to the interior profile of the tieback receptacle.

19. The method according to claim 18 wherein the step of connecting the tieback receptacle to the wellhead housing comprises latching the tieback receptacle to an exterior portion of the wellhead housing without rotation.

20. The method according to claim 18 wherein the step of securing the tieback conduit to the interior profile comprises securing the tieback conduit to he interior profile without rotation of the tieback conduit.

* * * * *